US011035117B2

(12) United States Patent
McNamara

(10) Patent No.: US 11,035,117 B2
(45) Date of Patent: Jun. 15, 2021

(54) WATERSTOP WITH DYNAMIC-SEALING HYDROPHILIC THERMOPLASTIC EXPANSIBLE SOFT FLANGES

(71) Applicant: Bernard McNamara, St-Lambert (CA)

(72) Inventor: Bernard McNamara, St-Lambert (CA)

( * ) Notice: Subject to any disclaimer, the term of this patent is extended or adjusted under 35 U.S.C. 154(b) by 21 days.

(21) Appl. No.: 16/744,387

(22) Filed: Jan. 16, 2020

(65) Prior Publication Data

US 2020/0332516 A1 Oct. 22, 2020

Related U.S. Application Data

(60) Provisional application No. 62/836,117, filed on Apr. 19, 2019.

(51) Int. Cl.
*E04B 1/41* (2006.01)
*E04B 1/68* (2006.01)
(Continued)

(52) U.S. Cl.
CPC ..... *E04B 1/6806* (2013.01); *E04B 1/41* (2013.01); *E02D 31/004* (2013.01); *E02D 31/02* (2013.01); *E04B 1/68* (2013.01); *E04B 1/6815* (2013.01)

(58) Field of Classification Search
CPC ... E04B 1/684; E04B 1/66; E04B 1/68; E04B 1/6815; E04B 1/70; E04B 1/6806;
(Continued)

(56) References Cited

U.S. PATENT DOCUMENTS 2,834,198 A * 5/1958 Goodman ..... E04B 1/6806 52/396.02
3,440,934 A * 4/1969 Dill ..... E01C 11/02 404/74

(Continued)

OTHER PUBLICATIONS

DC International, "DC Hydrophilic Waterstop", www.dc-inter.com and www.dc-waterstop.com; Boucherville, Quebec, Canada.

(Continued)

*Primary Examiner* — Phi D A
(74) *Attorney, Agent, or Firm* — Jacob M. Ward; Ward Law Office LLC

(57) ABSTRACT

A waterstop assembly for use as embedded components in at least a pair of adjacent concrete slabs, defining elongated first and second waterstop panels including a main body sheet to which is mounted by coextrusion or insertion to both of its opposite top and bottom ends a soft expansible flange made from hydrophilic thermoplastic material. Each hydrophilic soft flange has such an expansion capability as to provide strong radially outward pressure applied by the soft flange against the adjacent concrete slabs, thus providing watertight interconnection therebetween. A welding block is taken in sandwich between overlapping transitional end portions of the first and second waterstop panels. Integral ridge and groove connectors interconnect the welding block with the waterstop panels. Resistance wires connected at one end to an electric power source fuse the welding block and the first and second waterstop panels, wherein a watertight joint is formed therebetween. An upright steel post is mounted spacedly parallel to a corresponding one of first and second waterstop panels, and a transverse anchor arm transversely spacedly retaining waterstop panel in upright operational condition parallel to the steel post before and during first concrete pour.

9 Claims, 11 Drawing Sheets

(51) Int. Cl.
*E02D 31/02* (2006.01)
*E02D 31/00* (2006.01)

(58) Field of Classification Search
CPC ..... E04B 1/41; E02D 31/004; E02D 31/02; E02D 31/025; E02D 31/04
See application file for complete search history.

(56) References Cited

U.S. PATENT DOCUMENTS 3,461,781 A * 8/1969 Weiner ..... E01C 11/106 404/48
4,041,665 A * 8/1977 de Munck ..... E02B 3/16 52/396.02
4,622,784 A * 11/1986 Black ..... E04B 1/6806 404/64
4,740,404 A * 4/1988 Otsugu ..... E01C 11/106 404/64
4,943,185 A * 7/1990 McGuckin ..... E02B 11/00 210/170.07
5,476,718 A * 12/1995 Ichizuka ..... C09K 3/10 405/267
5,988,648 A * 11/1999 Schmid ..... E04B 1/6816 277/316
6,289,645 B1 * 9/2001 Schmid ..... E04B 1/6806 403/269
6,298,621 B1 * 10/2001 Lee ..... E02D 5/185 52/302.6
6,564,520 B1 * 5/2003 Starke ..... E04B 1/70 52/302.1
6,684,579 B2 * 2/2004 Brunson ..... E04B 1/7061 52/169.14
6,685,196 B1 * 2/2004 Baerveldt ..... E01C 11/106 277/628
6,745,531 B1 * 6/2004 Egan ..... E04B 1/70 52/302.1
6,948,716 B2 * 9/2005 Drouin ..... E04B 1/6807 277/606
7,181,888 B1 * 2/2007 Facaros ..... E02D 31/02 52/169.5
7,806,624 B2 * 10/2010 McLean ..... E01C 11/106 404/47
9,988,814 B2 * 6/2018 Schluter ..... E04F 13/0885
2006/0191224 A1 * 8/2006 Iske ..... E02D 19/18 52/415

OTHER PUBLICATIONS

W.R. Meadows Du Canada, "PVC Waterstops", www.wrmeadows.com, Canada.
Sika Constructions, "Waterstop Installation Guide"; Bruce Zhu, Sika Greenstreak, United States.
Sika Building Trust, "PVC Waterspot—Installation Guide", www.Usa.Sika.com, United States.

* cited by examiner

WATERSTOP WITH DYNAMIC-SEALING HYDROPHILIC THERMOPLASTIC EXPANSIBLE SOFT FLANGES

CROSS-REFERENCE DATA

This patent application claims convention priority based upon currently U.S. provisional patent application No. 62/836,117 filed 19 Apr. 2019.

FIELD OF THE INVENTION

This invention relates to waterstop assemblies in the construction of reinforced concrete slabs to withstand hydrostatic pressure in an enclosure.

BACKGROUND OF THE INVENTION

During the construction of reinforced concrete structures to withstand hydrostatic pressure, it is necessary to insert, between two concrete pouring operations, a seal connecting these two concrete elements. This is particularly the case for junctions between bottom concrete foundations and overhanging concrete walls, and between the various concrete pouring joints for large upright walls. Indeed, to realize large reinforced concrete walls (for reasons of logistics and concrete curing), it is necessary to cast these walls in several stages spaced in time. Joining elements must be included between each of the concrete pouring steps.

Prior art waterproofing blades, called waterstops in the trade, are commonly used for this purpose. These sealing blades can be for example 10 cm (4 in), 15 cm (6 in), or 20 cm (8 in) wide, and several meters or tens meters or more in length, to withstand hydrostatic water column pressures from several meters in height or more.

Construction of reinforced concrete basins requires a watertight structure, proper waterstop installation, proper joint detailing and quality waterstop materials. The waterstop must be installed prior to first concrete pouring to ensure proper positioning and concrete consolidation around the waterstop. Installation procedures are as follows:

a. tie-off to adjacent rebar through factory installed grommets/hog rings;

b. proper alignment with joint (centered in joint);

c. heat welded connections;

d. proper consolidation of concrete slabs around the waterstop; and e. providing split formwork bulkheads.

Some of the prior art waterstop assemblies are made of thermoplastic material, such as PVC (polyvinyl chloride) or TPE (thermoplastic elastomer).

PVC or TPE waterstops in the construction industry are formulated and compounded using resins. PVC waterstops are for use in concrete joints subjected to hydrostatic pressure. Embedded in concrete, PVC waterstops span the joint with the goal of forming a continuous, watertight diaphragm to prevent the passage of liquid through the joint. The waterstop must be properly selected and installed to accommodate joint expansion, contraction, and other longitudinal and transverse movements. In addition to these considerations, the waterstop main body material must also be resistant to any liquid to which the waterstop may be exposed.

The weakness of these prior art waterstops is that they cannot ensure a complete seal, because the water from the basin enclosure ends up infiltrating around the waterstop under hydrostatic pressure from the volume of water inside the basin, and if the concrete has structural weaknesses or if there are air bubbles trapped inside the concrete, the water may seep through the waterstop. Indeed, a problem with prior art waterstop designs is the formation of air gaps formed between concrete and waterstop, thus creating fluid leak pathways.

Thermoplastic waterstops must be properly secured prior to concrete placement. This is accomplished with prior art factory-applied grommets or pre-punched holes, or field-applied hog rings placed on centers between the two outermost ribs of the waterstop. Tie wire is looped through the hog ring, grommet, or punched hole and tied off to adjacent reinforcement. However, such prior art tie wire only partly secures the waterstop panel so that some displacement of the waterstop does occur during concrete placement, thus constituting a weakness of prior art waterstop installations. Indeed, during prior art waterstop assembly installations, anchoring nails or screw are sometimes required to be driven through the body of the waterstop, thus compromising integrity thereof with respect to its waterproofness.

Another weakness with prior art waterstop designs is the installation requirement of thoroughly consolidating the concrete around the waterstop to prevent voids or honeycombing adjacent to the waterstop, and of paying particular attention to the underside of horizontally placed waterstops to ensure proper concrete consolidation, wherein close contact between the concrete and waterstop is necessary for full performance of a waterstop. Indeed, voids next to the waterstop can significantly compromise water stopping ability thereof.

Furthermore, in prior art waterstops, the installer must maintain adequate clearance between reinforcing steel and the waterstop. Typical clearance is about twice the maximum aggregate size. Inadequate clearance can promote formation of voids due to aggregate bridging.

With respect to splicing requirements, continuity of the thus formed waterstop continuous diaphragm is very important for optimum water-tight performance of the waterstop system. Prior art waterstop systems often produce poorly constructed transitions, intersections and splices which constitute prime locations for through water leaks. Lapping of the prior art waterstop assembly (i.e. joint formation with overlapping waterstop panels) is contrary to current best practices for those skilled in the art. Continuity of the waterstop profile, including ribs, dumbbells and center bulbs is very important and is intended to be maintained through changes of direction and transitions. Continuity is maintained at these locations by use of in situ performed welding operations. Thermoplastic waterstop may be butt spliced with prior art thermostatically controlled waterstop welding iron.

A skilled worker is necessary to quickly remove the welding irons from the ends of the waterstop in a timely fashion and to immediately press the two waterstop ends together, keeping the waterstop properly aligned at the weld, until the waterstop material has fused and cooled. The splice must cool completely before installing. Surface temperature of the welding iron must be maintained to avoid burning or charring the material.

It is well known in the art that sealing of such waterstop assembly intersections are technically difficult to accomplish on site even for the workers skilled in the art. This type of end to end sealing method is often of poor quality and this constitutes the weak link in the waterstop assembly. This is because the working environment is challenging to the worker, and also the worker needs to be skilled in his art to be able to perform adequately the end to end thermoplastic panels sealing.

According to tests performed by the present applicant, the true effectiveness of prior art waterstops is limited to resisting pressure not exceeding 6.1 meters (20 feet) of water column pressure, notwithstanding claims of alleged higher performance advertised by other manufacturers.

OBJECTS OF THE INVENTION

One object of the present invention is therefore to address the current problem with prior art methods of end to end sealing of adjacent waterstop panels done in situ with hot welding irons welding the thermoplastic waterstops end to end.

A corollary object of the present invention is to enable any unskilled worker to easily perform in situ the sealing operation at end to end waterstop overlapping joints.

An object of the present invention is to achieve a waterstop seal capable of compensating for withdrawals of embedded concrete slabs to achieve a degree of sealing much higher than that of prior art waterstops.

An object of the present invention is to provide a waterstop assembly particularly well suited for the manufacture of formworks for the construction of large concrete tanks for the aquaculture industry, and other civil works such as underground parking and tunnels.

A general object of the present invention is to improve upon waterproofness integrity in waterstop assembly installations, with better contact between the waterstop and the concrete slabs into which is at least partly embedded the waterstop assembly.

SUMMARY OF THE INVENTION

The present invention relates to waterstop thermoplastic hydrophilic extrusions. The hydrophilic waterstop is specially designed to be installed on site and to prevent the passage of water under hydrostatic pressure loads through joints in liquid containing tanks or basins or other structures. The waterstop has the benefit of prior art PVC waterstop but combined with a hydrophilic component to make joints between concrete elements fully waterproof. The hydrophilic waterstop is therefore made from a material made with PVC and a hydrophilic thermoplastic that provides a controlled expansion to the waterstop responsively with contact with water. The waterstop produces enough swelling pressure to withstand high hydrostatic pressure, even when exposed to salt water.

Tests performed under the supervision of the Montreal, Canada-based building envelope testing engineering service provider UL (Underwriters laboratories) CLEB and in their facilities, demonstrate that this waterstop assembly may resist pressures equivalent to 250 feet (76.2 meters) of water column pressure, will resist dislodgment during concrete pouring, and will provide high elasticity and tensile strength. Watertightness is therefore essential between tank concrete slabs or foundations and side walls. The performance of prior art waterstops for this purpose has been unsatisfactory and thus applicant has developed a more efficient model. The present invention thermoplastic waterstop has a pair of soft hydrophilic flanges inserted at both of its opposite ends, in coextrusion mode. These hydrophilic flexible flanges provide an additional liquid barrier and substantially increase the performance of the waterstop. If the water comes along the soft expansible flange, reaching the hydrophilic profile at the ends of the waterstop, the material of the soft flanges will expand and completely seal the joint between the concrete slabs. The water will not be able to cross the two concrete slabs.

It is possible to extrude the waterstop into a thermoplastic material such as PVC or TPE and to coextrude (or alternately to insert) a hydrophilic TPE seal at both ends. These hydrophilic flange seals can be fused to the main waterstop material when it comes to TPE waterstops, or they can be attached using an adhesive injected into the production line for PVC.

With the present invention, a waterstop sealing strip of for example between 10 and 30 cm dimension can be used, which accommodates relative movements between the concrete slabs, and the hydrophilic soft flange at each of the two opposite ends of the waterstop seals the joint. The concrete shrinks as it dries, and this shrinkage creates a very small gap between the concrete and the thermoplastic sealing strip. This is in stark contrast with prior art waterstop designs, where the water would sneak around the edge of the waterstop and leak through the concrete slab, defeating its purpose.

With the present invention technology, a better seal is obtained between the reinforced concrete slabs that must withstand hydrostatic pressure, such as the water volume inside water basins, underground parking and tunnels. There is no equivalent prior art product, wherein the present invention waterstop will provide a solution to an unmet need in the industry, especially for works of civil works where waterproofing is essential, as for road tunnels and underpasses.

This waterstop may be flat, curved, or even elbowed. A right angle elbowed waterstop will however need a welded joint.

Each hydrophilic soft flange forming an expansion joint has an expansion capability of up to four (4) times its original volume. However, because the soft flange is embedded inside the concrete slab, it has very limited effective expansion room, so that strong radially outward biasing pressure is applied by the soft flange against the adjacent concrete slabs, thus providing watertight interconnection fit.

The waterstop must extend for all the perimeter of the concrete foundations as a diaphragm, and both opposite ends thereof must be welded together to make the whole watertight.

The waterstop includes an intermediate centerbulb, whose purpose is to accommodate extension thereof should there be relative motion in the concrete elements. The waterstop also includes a series of lengthwisely spaced cross-sectionally T-shape anchor members, provided to receive a tie member to support the waterstop spacedly over ground during concrete pouring.

In one embodiment, a single unitary waterstop according to the invention extends along the full perimeter of the concrete basin foundations. Accordingly, such waterstop can be sold in rolls. Alternately, two or more waterstop panels may be secured in overlapping end to end fashion in pairs.

More particularly, the present invention relates to a waterstop assembly for use as an embedded component in at least a pair of adjacent concrete slabs for structures withstanding hydrostatic pressures, said waterstop assembly defining elongated first and second waterstop panels including a main thermoplastic body sheet to which is mounted by co-extrusion to both of its opposite top and bottom ends a soft expansible flange made from hydrophilic thermoplastic material; each hydrophilic soft flange having such an expansion capability responsive to water leakage engagement as to provide strong radially outward pressure applied by the soft flange against adjacent surfaces of the adjacent concrete slabs, thus providing watertight interconnection therebetween; and further including a welding block, interlock means releasably taking in sandwich and interlocking said welding block in between overlapping transitional end portions of said first and second waterstop panels, and welding means fusing said welding block and said first and second waterstop panels whereby a watertight joint is formed therewith.

In one embodiment, said welding means includes a pair of high resistivity resistance wires, operatively connected at one end thereof to said welding block and coupled at opposite end thereof to a remotely located electrical power source, for example a battery, the electrical output of said battery sufficient for generating heat level such as to achieve structural material fusion of said welding block with said first and second waterstop panels so that said welding block and waterstop panels become as one. Said heat level at said welding block from said power source electrical output and high resistivity resistance wire could be about 380° F. (193° C.).

In one embodiment, each of said waterstop panels and said welding block include first and second opposite faces, and wherein said interlock means consists of a number of lengthwisely extending and widthwisely spaced cross-sectionally T-shape ridges projecting from each of said waterstop panels opposite faces, and a number of cross-sectionally T-shape grooves made along said welding block opposite faces with said grooves sized and shaped complementarily to said T-shape ridges for sliding removable interlock of said welding blocks first face grooves with said waterstop panels first face ridges. There could be added a lengthwisely extending centerbulb made along an intermediate section of each said waterstop panels in between a pair of opposite said T-shape ridges thereof.

In one embodiment, there is further included a steel post, mounted upright in spacedly parallel fashion to at least one of said first and second waterstop panels, a transverse anchor arm transversely spacedly retaining said at least one waterstop panel in upright operational condition parallel to said steel post before and during first concrete pour, said anchor arm including a main leg, carrying at one end thereof a resilient C-shape clip and at its opposite end an arcuate clamp; said clip sized and shaped to snugly transversely engage and interlock in friction fit fashion with said steel post, while said arcuate clamp is sized and shaped to retainingly engage with a transversely registering cross-sectionally T-shape upper said ridge. A hinged cover could be mounted to said clamp for pivotal motion from an open inoperative clamp condition to a closed operative condition locking in place said clamp.

DETAILED DESCRIPTION OF THE DRAWINGS

Figure 1:
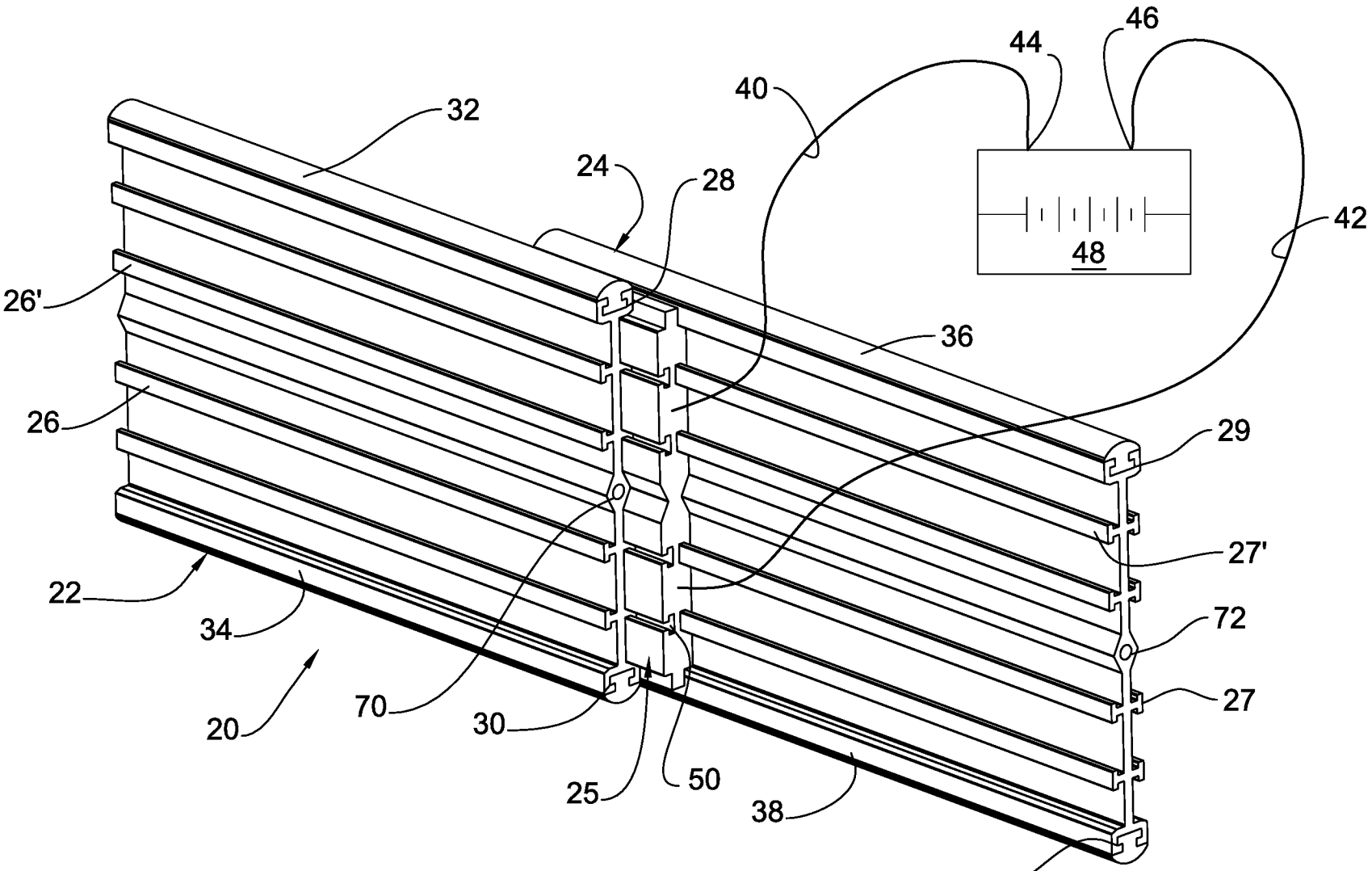
FIG. 1 is a perspective view of a pair of elongated waterstop thermoplastic extrusion panels with hydrophilic flanges according to one embodiment of the invention, these panels having a generally rectangular shape and showing a pair of expansible soft flanges anchored at opposite ends thereof and edgewisely interconnected by a welding block of similar width but shorter length and taken in sandwich between overlapping edgewise portions of the two thermoplastic extrusion panels, and further showing an autonomous power source battery operatively connected to the welding block by a pair of heat-generating resistance coil wires.
Figure 2:
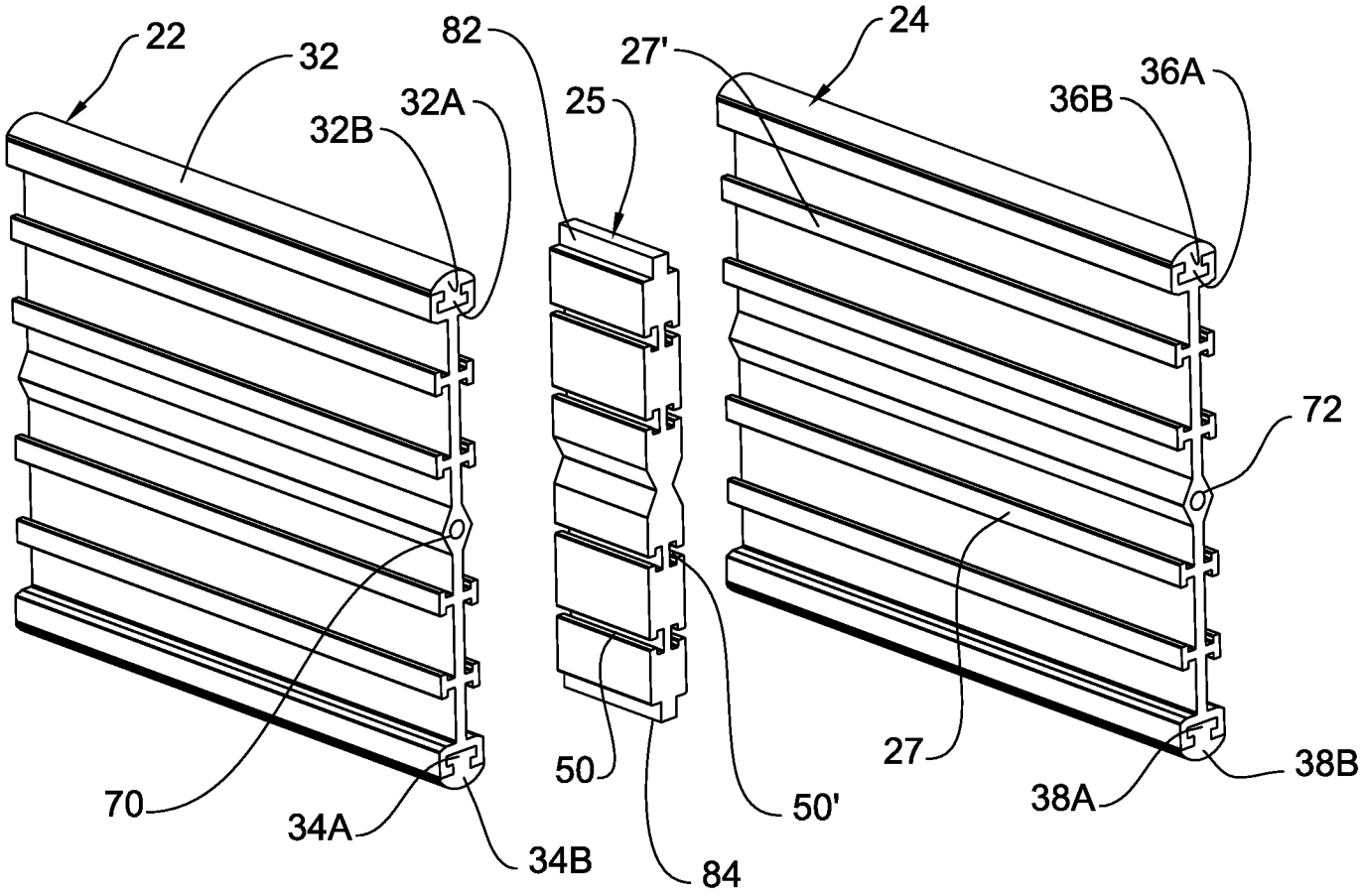
FIG. 2 is an exploded view of the components of FIG. 1, but with the battery and resistance wires removed for clarity of the view, and separately showing the welding block to be sandwiched between edgewise portions of the pair of edgewisely overlapping waterstop extrusion panels as shown in FIG. 1.

In the embodiment of waterstop assembly 20 shown in FIGS. 1-2, there is provided a pair of elongated rectangular waterstop panels 22, 24, and a welding block 25 as wide as but shorter in length than panels 22 and 24. Each waterstop panel 22, 24, defines a number (e.g. four as shown) of pairs of lengthwisely extending transversely spaced cross-sectionally T-shape semi-rigid ridges or anchor elements 26, 26' and 27, 27', respectively on opposite faces thereof, and two opposite cross-sectionally C-shape rails 28, 30, and 29, 31, respectively, and expansible hydrophilic top and botton (widthwise) flexible soft flanges 32, 34 and 36, 38, respectively embedded inside said rails 28, 30, and 29, 31. Each soft flange 32-38 has an interior portion 32A, 34A, 36A and 38A, respectively anchored in friction-fit fashion inside the enclosures 28A, 30A, of rails 28, 30, respectively, and an exterior exposed portion 32B, 34B, 36B, 38B, respectively projecting outwardly from rails 28, 30, 29 and 31. Soft flanges 32-38 form co-extruded hydrophilic inserts within the open enclosures of rails 28, 30, and 29, 31, respectively.

Separate welding block 25 includes a number of pairs of cross-sectionally T-shape lengthwise grooves 50, 50', . . . on opposite faces thereof, numbered, sized and shaped for complementary removable sliding engagement by corresponding cross-sectionally T-shape ridges 26, 26', . . . and 27, 27', . . . of waterstop panels 22, 24. Accordingly, the two panels 22, 24 and the block 25 shown detached from one another in FIG. 2 can be releasably slidingly interlocked with cross-sectionally T-shape ridges 26, 26', . . . and 27, 27', . . . engaging grooves 50, 50', . . . in end to end portions joint overlapping fashion as illustrated in FIG. 1.

A pair of heat-generating resistance wires 40, 42, are connected at one end thereof to opposite end portions of welding block 25, and to their opposite ends to the anode 44 and cathode 46 of a remotely located electrical battery 48. Each resistance wire 40, 42, has a high coefficient of resistivity and high resistance to oxidation, leading to optimal heat generation. In one embodiment, wires 40, 42, are made from a non-magnetic 80/20 alloy of Nickel and Chromium. Wires 40, 42, may be wound into coils, for improved performance. Wires, 40, 42 may have for example a resistivity of $110\times10^{-6}$ ohm-cm. The structural material of block 25 will be such, upon powered up by electrical battery 48, as to enable heat fusing of both overlapping end portions of waterstop panels 22, 24 including T-shape ridges 26, 26', 27, 27', . . . within grooves 50, 50', so that the overlapped end portions of panels 22, 24, become one with welding block 25 in watertight fashion. In one embodiment, block 25 is made of PVC plastic. In one embodiment, fusion temperature generated by resistance coil wires 40, 42, will be about 380° F. (193.3° Celsius).

Electric power sources other than battery 48 are not excluded from the scope of the present invention.

Figure 3:
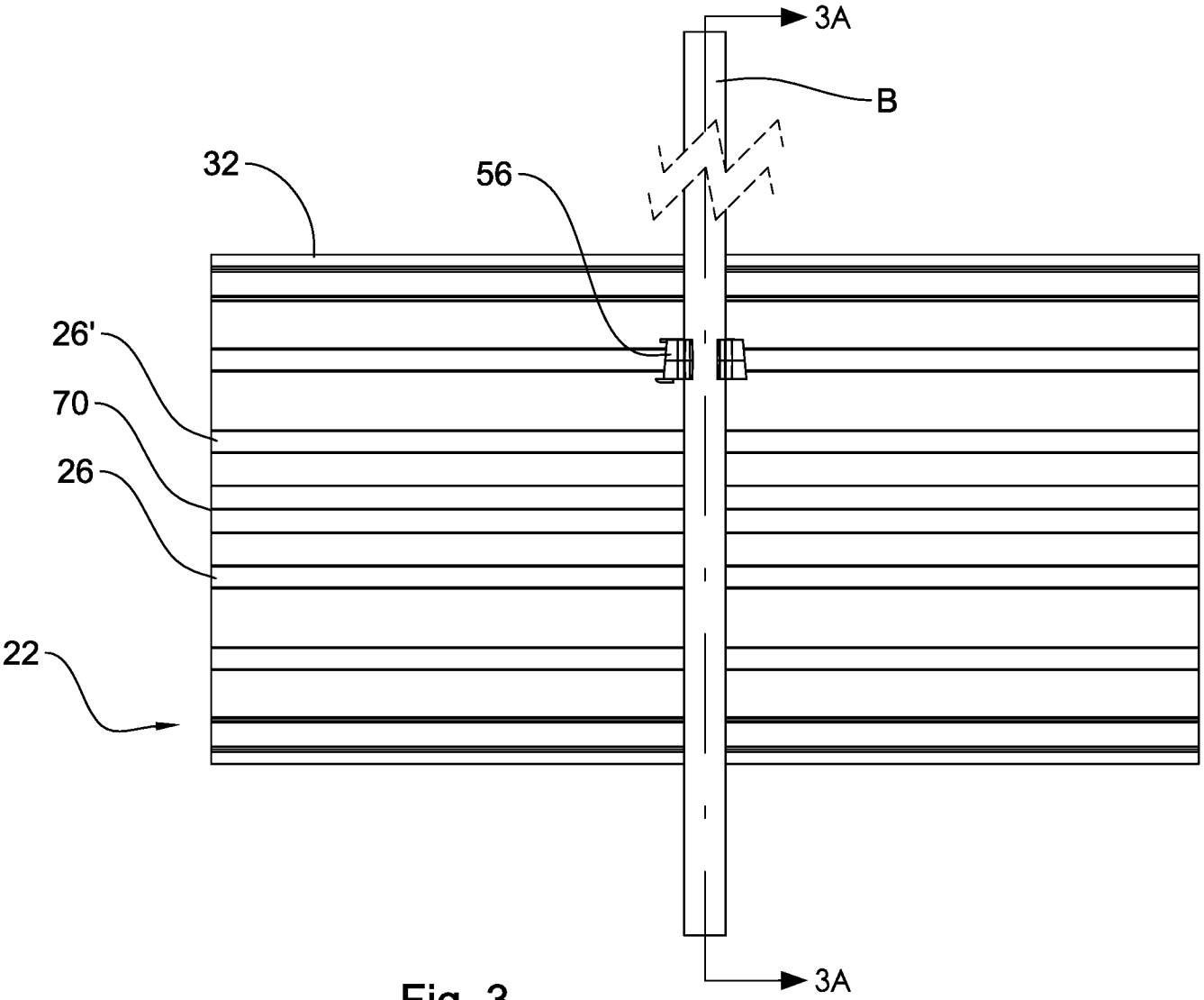
FIG. 3 is a plan view of one extrusion panel from FIG. 1, and further showing an upright steel bar extending spacedly parallel thereto.
Figure 3A:
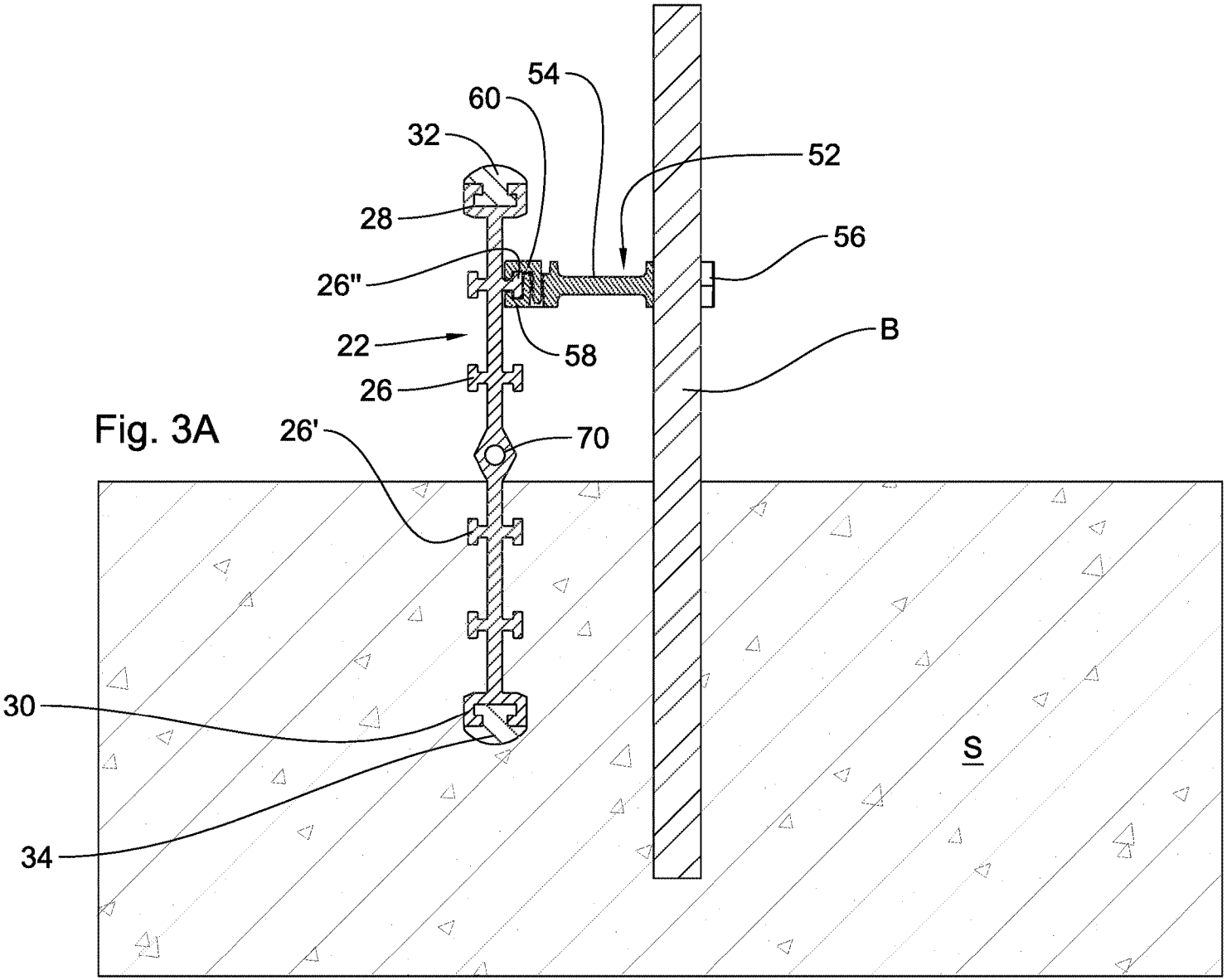
FIG. 3A is a cross-sectional view along line 3A-3A of FIG. 3, and further showing a foundation concrete slab from a first concrete pour into which are embedded the lower portion of the extrusion panel and of the upright steel bar, and also showing a hook arm transversely spacedly interlocking an upper portion of the extrusion panel with the upright steel bar, the combined said hook arm and upright steel bar providing support in upright condition of the waterstop panels during first concrete pouring.
Figure 5:
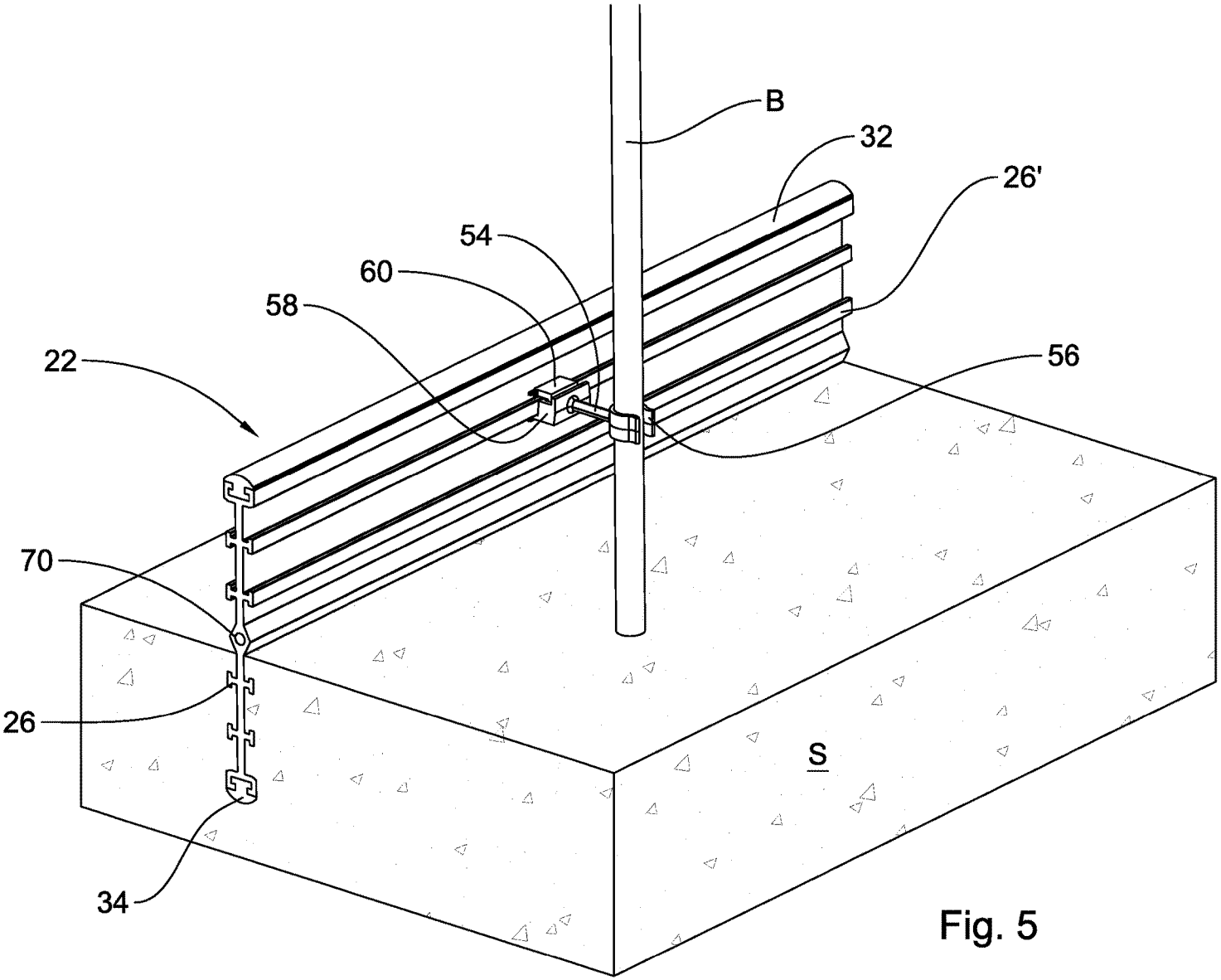
FIG. 5 is a perspective view at a smaller scale of the components of FIG. 3A.

FIGS. 3A and 5 show how the lower portion of upright waterstop panel 22 is half-embedded into a concrete foundation slab S.

Figure 4:
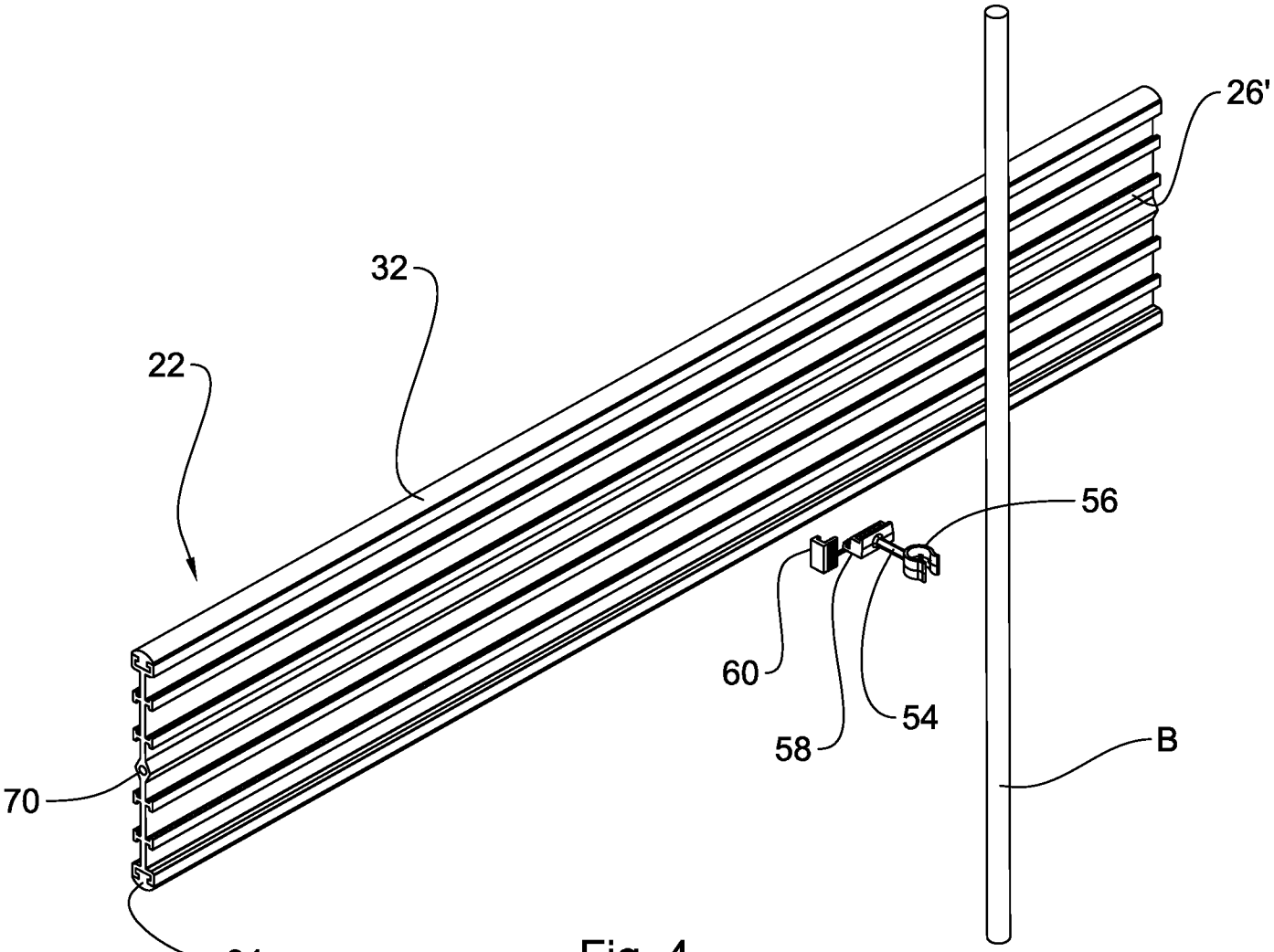
FIG. 4 is an exploded view at a smaller scale of the components of FIG. 3A, but with the concrete slab removed for clarity of the view.

To support waterstop panel 22 (24) in upright operational standing condition as shown in FIGS. 3A and 5, before and during first foundation concrete pour, an upright steel post B is mounted spacedly parallel to waterstop panel 22 (24). Diameter of post B may be e.g. 0.5 inch (1.26 cm). A transverse anchor arm 52 is provided that transversely spacedly retains waterstop panel 22 (24) in upright operational condition parallel to steel post B. Anchor arm 52 includes a main leg 54, carrying at one end thereof a resilient C-shape clip 56 and at its opposite end an arcuate clamp 58. C-shape clip 56 is sized and shaped to snugly transversely engage and interlock in friction fit fashion with steel post B, while arcuate clamp 58 is sized and shaped to retainingly engage with a transversely registering cross-sectionally T-shape upper ridge 26" from panel 22 (24). A hinged cover 60 is further mounted to clamp 58 for pivotal motion from an open inoperative clamp condition shown in FIG. 4, to a closed operative condition (locking clamp 58 into place) shown in FIGS. 3A and 5.

Figure 6:
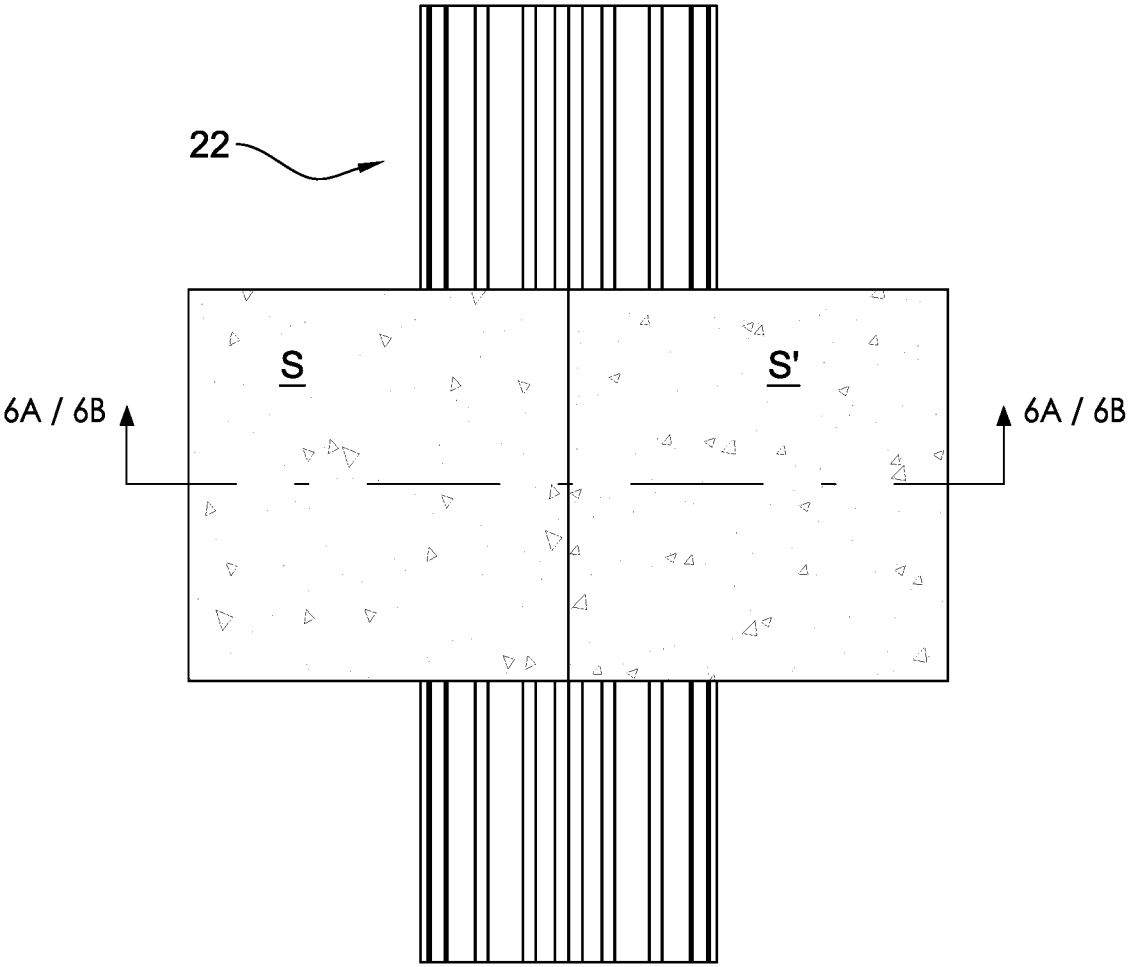
FIG. 6 is a plan view of an extrusion panel according to the embodiment of the invention, with adjacent associated pair of split formwork concrete slabs.

FIG. 6 shows an alternate way of using waterstop assembly 20 in split formwork setting, being half-embedded into the facing edge portions of two adjacent concrete slabs S and S'. FIGS. 1-2, 3A, 5, 6A-6B and 7-10 show that each waterstop panel 22, 24, includes a centerbulb 70, 72, respectively.

Figure 6A:
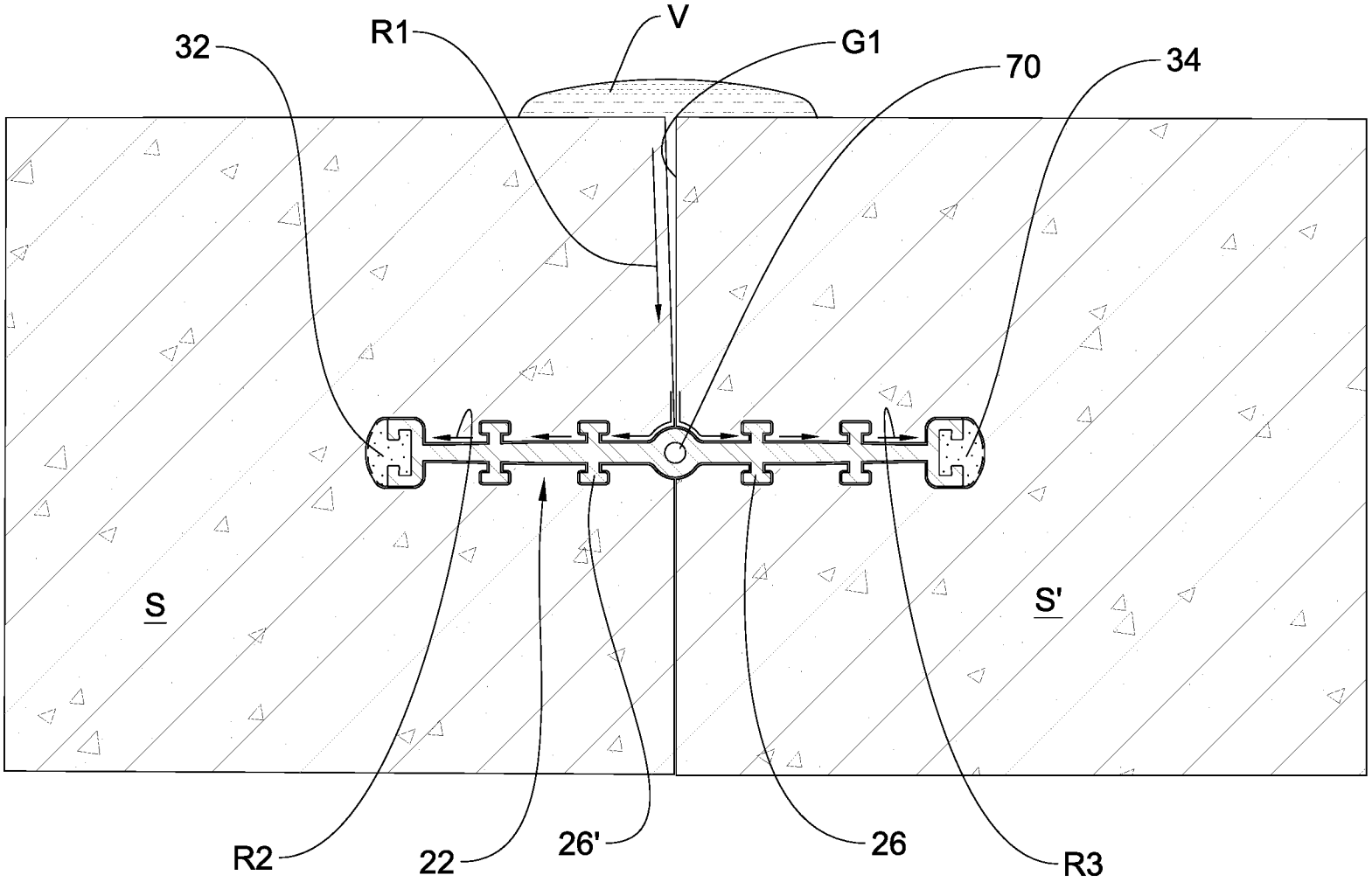
FIGS. 6A and 6B are enlarged cross-sectional views taken along lines 6A/6B-6A/6B of FIG. 6, sequentially suggesting the effect of hydrostatic pressure induced water seepage along the gap between the pair of adjacent split formwork concrete slabs, and also suggesting how the hydrophilic flanges provide waterproofness for the concrete slab/waterstop interface.
Figure 6B:
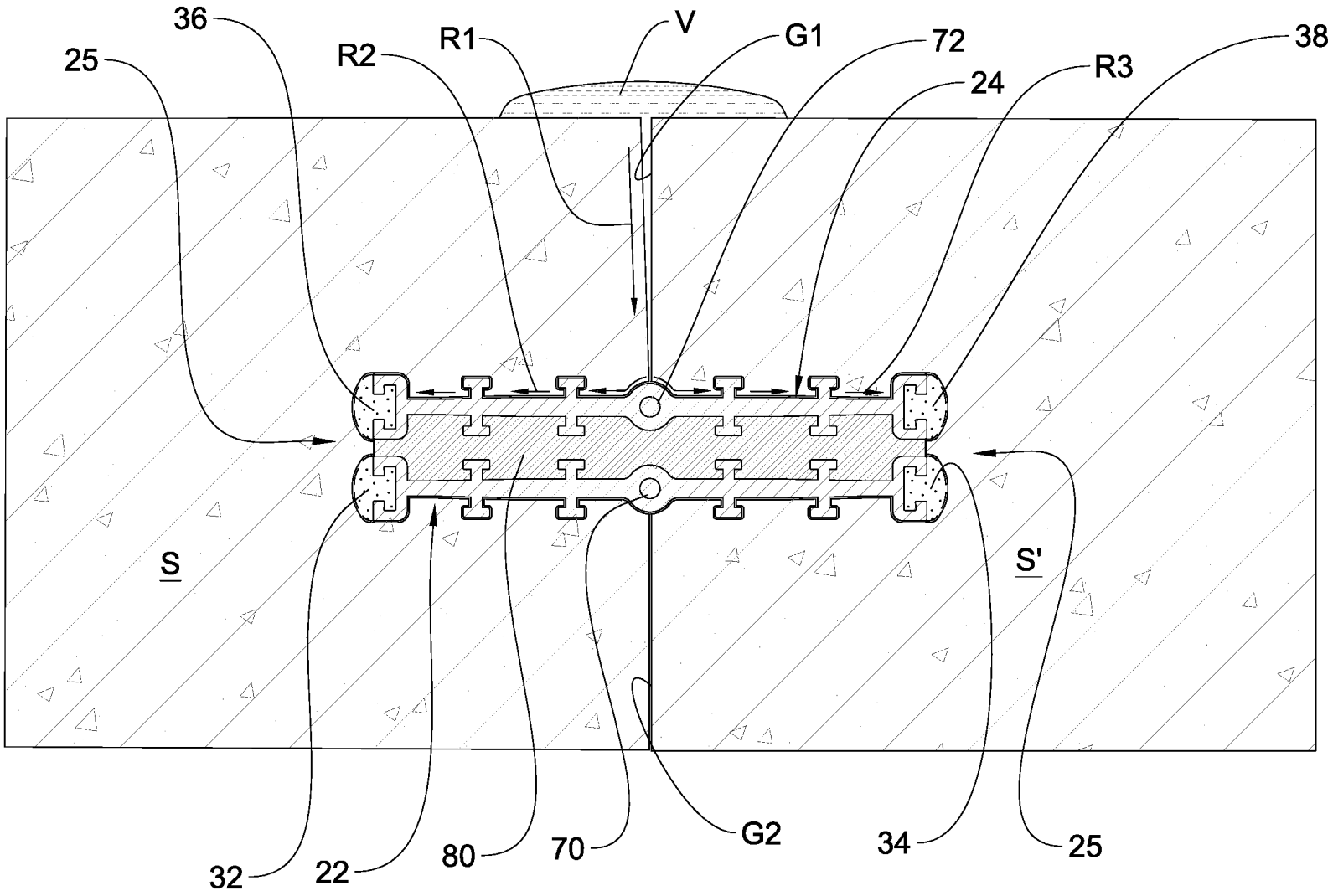
Figure 8:
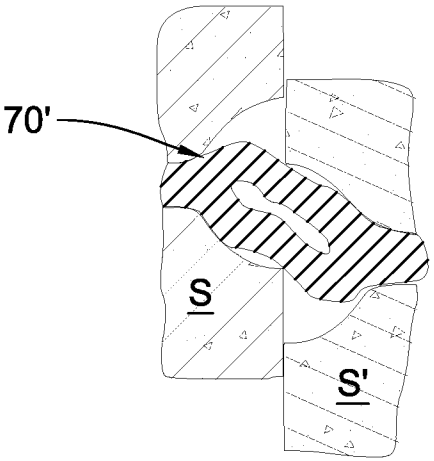
FIGS. 7 and 8 are enlarged cross-sectional views of the hydrophilic waterstop at the gap interface between the pair of adjacent concrete slabs, sequentially suggesting center bulb dynamic bulb deformation responsive to concrete slabs displacement loads relative to one another.
Figure 7:
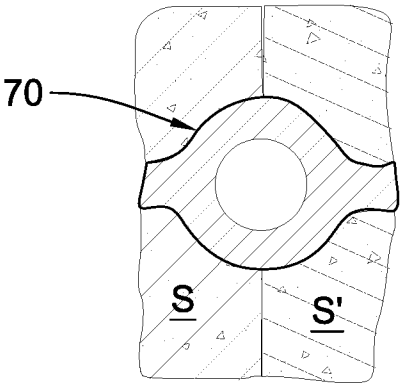
Figure 10:
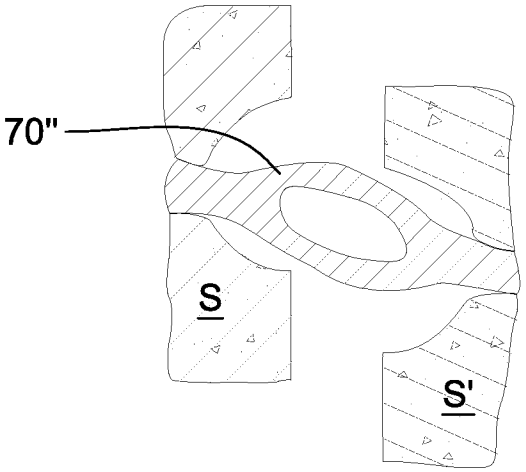
FIGS. 9 and 10 are sequential views similar to FIGS. 7 and 8 but showing alternate dynamic bulb deformation and associated transverse movement and lateral movement thereof.
Figure 9:
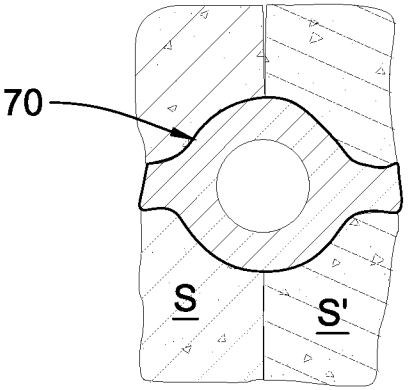

FIGS. 6A-6B further suggest how a volume of liquid V can seep transversely through a first inner gap G1 between the inner facing edges of the inner (half) section of concrete slabs S and S', along arrow R1, to eventually reach waterstop 24 (22). Such liquid leakage may then continue flowing transversely from arrow R1 along opposite liquid flow arrows R2 and R3 from centerbulb 72 (70) over waterstop panels 24 (22), toward hydrophilic soft flanges 36, 38 (32, 34). These hydrophilic flanges under contact with water will then responsively apply an expansion biasing pressure against the adjacent portions of concrete slabs S and S', thus creating a watertight seal therebetween (FIG. 6B). This watertight seal prevents fluid flow from edgewisely seeping around flanges 32-38 and from reaching a second gap G2 between the facing edges of the outer section of concrete slabs S and S'. Accordingly, outer gap G2 will remain dry in all circumstances.

In FIG. 6B, the hatched portion 80 between the two waterstop panels 22, 24, represents the free air volume therebetween, with this free air volume being sealed at opposite waterstop lengthwise ends by the fused welding block 25 in the background of hatched portion 80 and shown in FIG. 2 but absent from FIG. 6B.

FIGS. 7-10 suggest deformation of centerbulb 70 (72) under concrete slabs load deformations at 70' (FIG. 8) or 70" (FIG. 10), so that the waterstop assembly act properly as an expansion joint during any structural slab motion, enabling retaining structural integrity thereof including waterproofness. The waterstop design includes ribs with a centerbulb, whose purpose is to prevent passage of liquid through the joint. Such ribbed centerbulb profile is for application to both expansion and contraction joints, and will accommodate transverse and lateral slab movements. The ribs provide good watertight slabs interlock. The centerbulb accommodates typical joint movement.

As already discussed in the background of the invention section, a problem with prior art methods of edgewise sealing of adjacent waterstop panels is that this is done in situ with welding irons heat-welding the thermoplastic waterstops end to end. This type of end to end sealing method is often of poor quality and this constitutes the weak link in the waterstop assembly. This is because the working environment is challenging to the worker, and also the worker needs to be skilled in his art to be able to perform adequately the end to end thermoplastic panels sealing. Prior art waterstop overlapping at intersection end portions is to be completely avoided under skilled workers best practices, i.e. clearly teaches away from waterstop end portions overlapping. On the contrary, with the present completely unobvious waterstop system, waterstop end to end portion overlapping is promoted rather than eschewed, and an unskilled worker can easily perform the sealing operation as well as a skilled worker, since the manual operation of applying welding irons to the waterstop panels edge portions is replaced by an automatic welding operation with resistance coil wires 40, 42, connected to electrical battery 48 and coupled to a welding block 25 fixedly sandwiched between two edgewise overlapping end portions of the waterstop panels 22, 24.

In one embodiment as shown in FIG. 2, welding block 25 further includes a pair of integral lips 82, 84, projecting edgewisely outwardly from opposite ends thereof and extending parallel to block grooves 50, 50', . . . . Lips 82, 84 provide still improved waterproofness at the level of meeting soft flanges 32, 36 or 34, 38 when welding block 25 is taken in sandwich between corresponding pair of waterstop panels 22, 24.

Under experimental tests performed by applicant, the present waterstop has been found to be effective in fully resisting pressure equivalent to 250 feet (76.2 meters) of water column pressure, that is at a pressure level significantly higher than prior art waterstop. The present waterstop is easy to install by an unskilled worker, will resist accidental dislodgment during concrete pouring, will boast high elasticity and tensile strength, and is corrosion resistant in that its thermoplastic structural material is unaffected by acids, alkali, salts or other chemicals. The hydrophilic soft flanges at the lengthwise edges of the the present waterstop are swellable up to 400%. Each waterstop panel 22, 24, may have e.g. several meters in length, and may be flexible so as to be shipped in rolls.

The welding battery 48 may be of low (e.g. 12 volts) voltage, such as a car battery, or alternately could be of high (e.g. 110 volts) voltage. Other power sources are not excluded from scope of the present invention.

I claim:

1. A waterstop assembly for use as an embedded component in at least a pair of adjacent concrete slabs for structures withstanding hydrostatic pressures, said waterstop assembly defining elongated first and second waterstop panels including a main thermoplastic body sheet to which is mounted by co-extrusion to both of its opposite top and bottom ends a soft expansible flange made from hydrophilic thermoplastic material; each hydrophilic soft flange having such an expansion capability responsive to water leakage engagement as to provide strong radially outward pressure applied by the soft flange against adjacent surfaces of the adjacent concrete slabs, thus providing watertight interconnection therebetween; and further including a welding block, interlock means releasably taking in sandwich and interlocking said welding block in between overlapping transitional end portions of said first and second waterstop panels, and welding means fusing said welding block and said first and second waterstop panels whereby a watertight joint is formed therewith.

2. A waterstop assembly as in claim 1, wherein said welding means includes a pair of high resistivity resistance wires, operatively connected at one end thereof to said welding block and coupled at opposite end thereof to a remotely located electrical power source, the electrical output of said power source sufficient for generating heat level such as to achieve structural material fusion of said welding block with said first and second waterstop panels so that said welding block and waterstop panels become as one.

3. A waterstop assembly as in claim 2, wherein said heat level at said welding block from said power source electrical output and high resistivity resistance wire is about 380° F. (193° C.).

4. A waterstop assembly as in claim 1, wherein each of said waterstop panels and said welding block include first and second opposite faces, and wherein said interlock means consists of ridge members, integral to said water stop panels opposite faces, and groove members, integral with said welding block opposite faces.

5. A waterstop assembly as in claim 4, wherein said ridge members consist of a number of lengthwisely extending and widthwisely spaced cross-sectionally T-shape ridges projecting from each of said waterstop panels opposite faces, and wherein said groove members consist of a number of cross-sectionally T-shape grooves made along said welding block opposite faces with said grooves sized and shaped complementarily to said T-shape ridges for sliding removable interlock of said welding blocks first face grooves with said waterstop panels first face ridges.

6. A waterstop assembly as in claim 5, further including a lengthwisely extending centerbulb made along an intermediate section of each said waterstop panels in between a pair of opposite said T-shape ridges thereof.

7. A waterstop assembly as in claim 5, further including a steel post, mounted upright in spacedly parallel fashion to at least one of said first and second waterstop panels, a transverse anchor arm transversely spacedly retaining said at least one waterstop panel in upright operational condition parallel to said steel post before and during first concrete pour, said anchor arm including a main leg, carrying at one end thereof a resilient C-shape clip and at its opposite end an arcuate clamp;

said clip sized and shaped to snugly transversely engage and interlock in friction fit fashion with said steel post, while said arcuate clamp is sized and shaped to retainingly engage with a transversely registering cross-sectionally T-shape upper said ridge.

8. A waterstop assembly as in claim 7, further including a hinged cover mounted to said clamp for pivotal motion from an open inoperative clamp condition to a closed operative condition locking in place said clamp.

9. A waterstop assembly as in claim 1, wherein said welding block further includes a pair of integral lips projecting edgewisely outwardly from opposite ends thereof and extending parallel to said grooves, whereby still improved waterproofness is achieved at the level of said soft expansible flanges when said welding block is taken in sandwich between corresponding pair of said waterstop panels.

* * * * *